US005255796A

United States Patent [19]

Josephson

[11] Patent Number: 5,255,796

[45] Date of Patent: Oct. 26, 1993

[54] EYEGLASSES SUPPORTING ASSEMBLY

[76] Inventor: Lawrence B. Josephson, 9465 Dewey Ave., Omaha, Nebr. 68114

[21] Appl. No.: 979,905

[22] Filed: Nov. 23, 1992

[51] Int. Cl.[5] ..... A47F 7/00

[52] U.S. Cl. ..... 211/13; 248/220.2; 248/902

[58] Field of Search ..... 211/13, 87; 248/902, 248/220.2, 220.3

[56] References Cited

U.S. PATENT DOCUMENTS

| | | | |
|---|---|---|---|
| 3,884,357 | 5/1975 | Bloch | 211/13 |
| 3,895,718 | 7/1975 | Seiller | 211/13 |
| 4,286,764 | 9/1981 | Pfeifer | 248/220.3 |
| 4,540,093 | 9/1985 | Merl et al. | 248/220.3 X |
| 5,056,668 | 10/1991 | Berger | 248/902 X |
| 5,100,006 | 3/1992 | Forrester | 248/902 X |
| 5,144,345 | 9/1992 | Nyman | 248/902 X |

*Primary Examiner*—Robert W. Gibson, Jr.
*Attorney, Agent, or Firm*—George R. Nimmer

[57] ABSTRACT

Ancillary to customer self-service retailing of dual-lenses eyeglasses based upon upright display-panels and provided with vertically-spaced supporting assemblies for holding displayed eyeglasses, there is disclosed herein improved eyeglasses supporting assemblies for attachment to an upright display-panel. The improved eyeglasses supporting assembly concept of the present invention utilizes: a display-panel connector, such as an upright shoulder engageable with a vertically-elongated slotted portion of an upright display-panel; extending horizontally forwardly from a lower portion of the display-panel connector and along a vertical-plane, a horizontal supporting-bar having a horizontal upper-side adapted to support therealong a plurality of customer-withdrawable eyeglasses) and a horizontal lower-side; and extending horizontally forwardly from an upper portion of the display-panel connector and along said vertical-plane, a relatively laterally broad steadying-bar adapted to topically steady eyeglasses supported upon the supporting-bar upper-side. When a plurality of eyeglasses supporting assemblies are connected in closely-neighboring vertically-aligned positions to the display-panel, the supporting-bar lower-side desireably forwardly includes a downward-lobe to ensure that a self-service customer will correctly replace an empirically rejected pair of eyeglasses upon the supporting-bar upper-side rather than incorrectly upon the steadying-bar.

4 Claims, 1 Drawing Sheet

EYEGLASSES SUPPORTING ASSEMBLY

BACKGROUND OF THE INVENTION

As typified by the disclosures of U.S. Pat. Nos. 3,884,357, 5,056,668, and 5,100,006, customer self-service retailing of dual-lensees eyeglasses (including frames therefor) entails an upright display-panel provided with horizontally extending supporting-bars upon which removably rest eyeglasses and/or frames for the customer to retrieve and replace during customer evaluation thereof. The retailing modes disclosed in these prior Patents suffer from various disadvantages and deficiencies including, iner-alia: inability to reliably support eyeglasses and frames thereupon in readily merchandiseable form; inability to re-accommodate thereupon eyeglasses and frames evaluated, but rejected, by the self-service customer; inability to efficiently utilize the available upright area of the display-panel; and inability to economically manufacture the inter-dependent upright-display-panel and cooperating supporting-bars for the eyeglasses and/or frames.

GENERAL OBJECTS OF THE INVENTION

It is accordingly the general object of the present invention to provide eyeglasses supporting assemblies for the self-service merchandising of dual-lenses eyeglasses and frames therefor, and which are not fraught with the disadvantages and deficiencies associated with self-service retailing eyeglasses supporting assemblies of the prior art.

GENERAL STATEMENT OF THE INVENTION

With the above general objectives in view, and together with other related and ancillary objectives which will become more apparent as this description proceeds, the eyeglasses supporting assembly of the present invention is connectably locatable at and horizontally extendable away from one or more vertically-aligned positions of an upright retailing display-panel and generally comprises: a rearwardly positioned connector means to the display-panel, such as an upright shoulder adapted to removably engage a vertically-slotted portion of the upright display-panel: extending horizontally forwardly from a lower portion of the connector means and along a vertical-plane, a supporting-bar having a forward-end and a horizontal upper-side laterally flanking said vertical-plane and adapted to removably support dual-lenses eyeglasses (or frames therefor) thereupon, and a laterally narrower lower-side, said supporting-bar upper-side being preferably forwardly provided with a concave depression, and said supporting-bar lower-side being preferably forwardly provided with a downward-lobe; and a horizontal steadying-bar extending sufficiently broadly laterally bi-directionally to flank the supporting-bar horizontal upper-side therebeneath.

BRIEF DESCRIPTION OF THE DRAWING

In the drawing, wherein like characters refer to like parts in the several views, and in which:

FIG. 1 also indicates that a plurality of closely-neighboring and vertically-aligned "eyeglasses supporting assemblies" might be advantageously employed along an upright retailing display-panel (8);

DETAILED DESCRIPTION OF THE DRAWING

Figure 1:
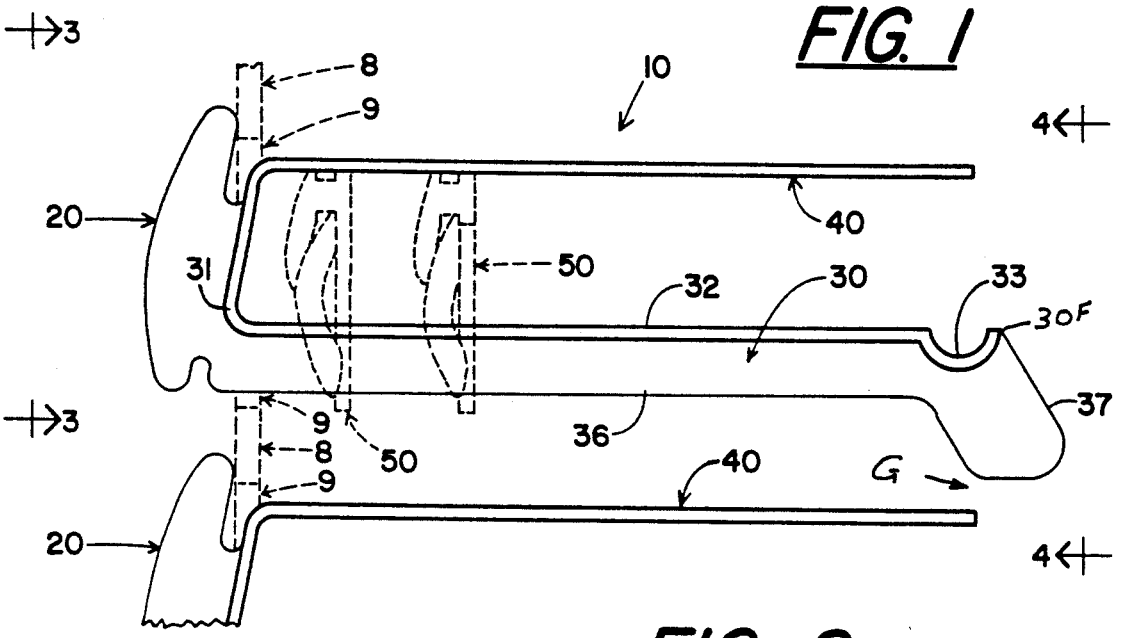
FIG. 1 is a side elevational view of a represenative embodiment (10) of the "eyeglasses supporting assembly" of the present invention and having a connector means portion (20) for removable attachment to an upright display-panel (8).
Figure 2:
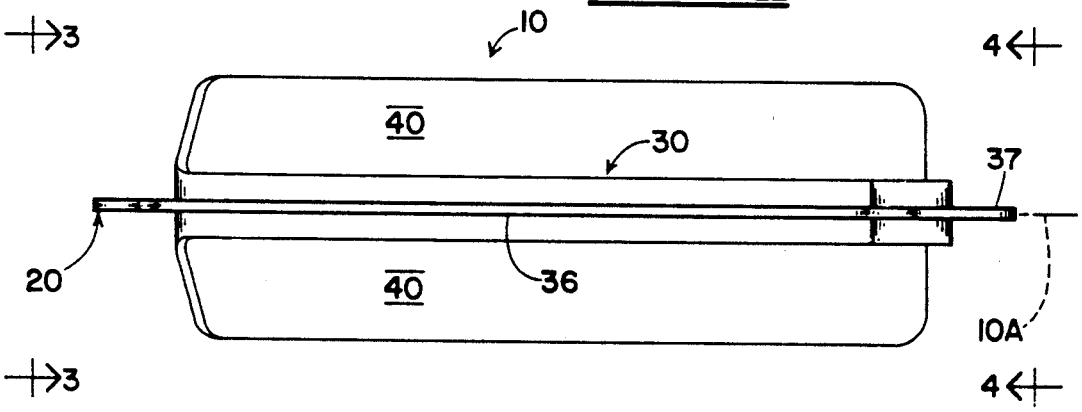
FIG. 2 is a bottom plan view of the FIG. 1 representative embodiment (10)
Figure 3:
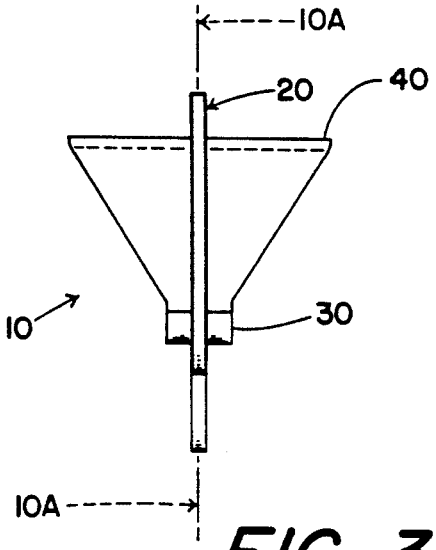
FIG. 3 is a rearward elevational as seen along lines 3—3 of FIGS. 1 and 2.
Figure 4:
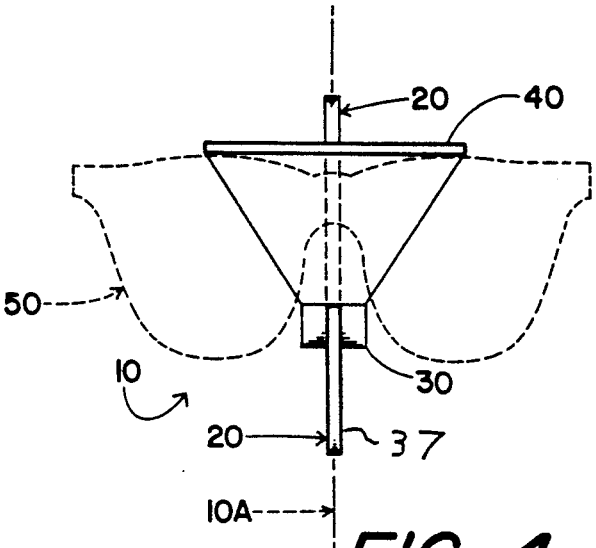
FIG. 4 is a forward elevational view as seen along lines 4—4 of FIGS. 1 and 2.

The eyeglasses supporting assembly concept of the present invention generally comprises: a rearwardly positioned connector means (20) for connecting said assembly to a selectable upright retailing display-panel (8); extending integrally horizontally forwardly from a lower portion of the connector means (20), a horizontal supporting-bar (30) having a rearward-end (31) and a forward-end (30F), having a horizontal lower-side (36), and also having a horizontal upper-side (32) adapted to removably support along the length thereof a plurality of dual-lenses eyeglasses (or frames therefor); and extending integrally horizontally forwardly from an upper portion of a said connector means (20), a horizontal steadying-bar (40) loftily overlying said supporting-bar and for topically steadying the eyeglasses or frames (50) resting upon the underlying supporting-bar (30). All three components (20, 30, 40) might be singularly constructed throughout, such as, for example, of a moldable resinous material (e.g. polycarbonate, or similar resinous material).

In the preferred eyeglasses or frames supporting assembly embodiment 10, the connector means preferably takes the form of an upright shoulder 20 lying along a vertical-plane 10A, said shoulder 20 being removably securely insertable through a vertical-slot 9 of a said slotted type display-panel 8. Moreover, such type display-panel 8 is desireably efficiently provided with a plurality of closely vertically neighboring vertically-elongated slotted portions 9.

For said embodiment 10, the preferred supporting-bar 30 also lies along said vertical-plane 10A, and has a horizontal upper-side 32 which directionally laterally flanks the supporting-bar lower-side 36. Supporting-bar upper-side 32 is desireably forwardly provided with a concave depression 33 that tends to prevent the retailable item (50) from falling-off its forward-end 30F. The supporting-bar lower-side 36 is desireably forwardly provided with a downward-lobe 37. In the latter regard, when a plurality of eyeglasses supporting assemblies (10) are efficiently utilized in closely neighboring vertical spacings (e.g. 9) of a display-panel, the downward-lobes 37 substantially meet the steadying-bars 40 therebeneath. Each of these very small-gaps (G) between neighboring overlying assemblies (10) ensure that a self-service customer will correctly replace an empirically rejected pair of eyeglasses or frames (50) upon a supporting-bar upper-side 32, rather than incorrectly upon a steadying-bar 40.

For said embodiment 10, the steadying-bar desireably extends sufficiently bi-directionally laterally from said vertical-plane 10A to broadly flank the supporting-bar upper-side 32.

From the foregoing, the construction and operation of the eyeglasses and frames supporting assembly of the present invention will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. For the self-service merchandising of dual-lenses eye-glasses and which merchandising utilizes at least one upright display-panel and therewith at least one eyeglasses supporting assembly connectable to and horizontally extendable away from said upright display-panel, an improved eyeglasses supporting assembly that is centrally located along a vertical-plane and comprises:

(A) a rearwardly positioned connector means for connecting said eyeglasses supporting assembly to a said upright display-panel;

(B) extending horizontally and directionally forwardly from a lower portion of said connector means and along said vertical-plane, a horizontal supporting-bar having a forward-end and a horizontal upper-side directionally perpendicularly laterally flanking said vertical-plane and adapted to removably support eyeglasses thereupon, and a lower-side; and (C) extending horizontally and directionally forwardly from an upper portion of said connector means and along said vertical-plane, a horizontal steadying-bar for topically steadying eyeglasses supported upon said supporting-bar, and said steadying-bar extending sufficiently horizontally bi-directionally from said vertical-plane to flank the supporting-bar horizontal upper-side therebeneath.

2. The eyeglasses supporting assembly of claim 1 wherein:

(A) the connector means for the display-panel comprises an upright shoulder extending along said vertical-plane and which upright shoulder is laterally narrower than said supporting-bar upper-side; and (B) the supporting-bar lower-side being laterally narrower than the upper-side thereof and being forwardly provided with a downward-lobe, and the supporting-bar upper-side being topically forwardly provided with a concave depression.

3. For the self-service merchandising of dual-lenses eye-glasses and which merchandising utilizes an upright display-panel provided with a plurality of closely vertically-positioned vertically-slotted and vertically-aligned portions, the combination therewith of at least two closely vertically-positioned and substantially identical eyeglasses supporting assemblies connected to an horizontally extending away from the respective display-panel vertically-slotted portions, each such eyeglasses supporting assembly extending along a vertical-plane and comprising:

(A) a rearwardly positioned upright shoulder extending along said vertical-plane and removably connected to a said display-panel vertically-slotted portion;

(B) extending horizontally and directionally forwardly from a lower portion of said upright shoulder and along said vertical-plane, a horizontal supporting-bar having a forward-end and a horizontal upper-side that directionally perpendicularly laterally flanks said vertical-plane and that is adapted to removably supports eyeglasses thereupon, and a lower-side; and (C) extending horizontally and directionally forwardly from an upper portion of said upright shoulder and along said vertical-plane, a horizontal steadying-bar for topically steadying eyeglasses supported upon said supporting-bar.

4. The combination of claim 3 wherein:

(i) the supporting-bar upper-side is topically forwardly provided with a concave depression; and (ii) the supporting-bar lower-side is laterally narrower than the upper-side thereof and is forwardly provided with a downward-lobe that provides a very-small gap between vertically-aligned eyeglasses supporting assemblies.

* * * * *